US005549133A

United States Patent [19]

Sigelakis

[11] Patent Number: 5,549,133

[45] Date of Patent: Aug. 27, 1996

[54] SECURITY DEVICE AND SYSTEM FOR PREVENTING UNAUTHORIZED ACCESS TO AND OPERATION OF FIRE HYDRANTS

[76] Inventor: George Sigelakis, 188 Beach 123rd St., Rockaway Beach, N.Y. 11694

[21] Appl. No.: 363,220

[22] Filed: Dec. 23, 1994

[51] Int. Cl.[6] ..... E03B 9/06

[52] U.S. Cl. ..... 137/296; 137/382; 137/800; 220/284

[58] Field of Search ..... 137/296, 382, 137/377, 800; 220/284

[56] References Cited

U.S. PATENT DOCUMENTS

| | | | |
|---|---|---|---|
| 468,781 | 2/1892 | Brentano | 137/296 |
| 556,500 | 3/1896 | Fox | 137/296 |
| 695,147 | 3/1902 | Denney | 137/296 |
| 1,708,395 | 4/1929 | Muller | 137/382 |
| 2,699,176 | 1/1955 | Ucciardi | 137/296 |
| 2,869,576 | 1/1959 | Kennedy | 137/296 |
| 3,379,209 | 4/1968 | Spiselman | 137/296 |
| 3,406,708 | 10/1968 | Maydock | 137/382 |
| 3,623,498 | 11/1971 | Manahan | 137/296 |
| 3,914,966 | 10/1975 | Bello | 137/296 |
| 4,033,372 | 7/1977 | Bowman | 137/296 |
| 4,062,375 | 12/1977 | Byrnes | 137/296 |
| 4,280,525 | 7/1981 | Byrnes | 137/296 |
| 4,484,595 | 11/1984 | Vanek et al. | 137/296 |
| 4,566,481 | 1/1986 | Leopold, Jr. et al. | 137/296 |
| 4,716,922 | 1/1988 | Camp | 137/296 |
| 4,736,765 | 4/1988 | Campbell | 137/296 |
| 4,827,969 | 5/1989 | Lyasko | 137/382 |
| 4,936,336 | 6/1990 | McCauley et al. | 137/296 |
| 5,094,265 | 3/1992 | Jackson et al. | 137/382 |

FOREIGN PATENT DOCUMENTS

| | | | |
|---|---|---|---|
| 0683937 | 11/1939 | Germany | 137/296 |
| 0813525 | 9/1951 | Germany | 137/296 |
| 0333147 | 12/1935 | Italy | 137/296 |

OTHER PUBLICATIONS

Penn Troy Machine Co. Brochure, Troy, Pennsylvania.

*Primary Examiner*—George L. Walton
*Attorney, Agent, or Firm*—Adduci, Mastriani & Schaumberg, L.L.P.

[57] ABSTRACT

A security device and system for preventing unauthorized access to and operation of fire hydrants. The security device includes a first end portion for coupling the device to a portion of a fire hydrant. The first end portion preferably is coupled to the hydrant by clamping it between an outlet port of the hydrant and a cap for covering the outlet port. A second end portion covers a valve control device of the hydrant to control access to the valve control device and thereby prevent unauthorized persons from activating it. An intermediate portion integral with the first and second end portions extends vertically from the first end portion to the second end portion. The system for preventing unauthorized operation of a fire hydrant includes the security device described above, a bonnet for protecting a valve control device of the hydrant, and a locking cap for closing an outlet port of the hydrant. The system also may include a tool for removing the locking cap from the outlet port and for opening the valve control device.

22 Claims, 5 Drawing Sheets

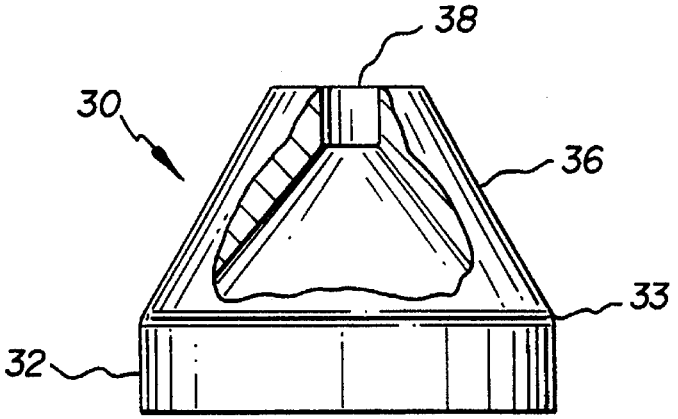
FIG. 10
FIG. 11
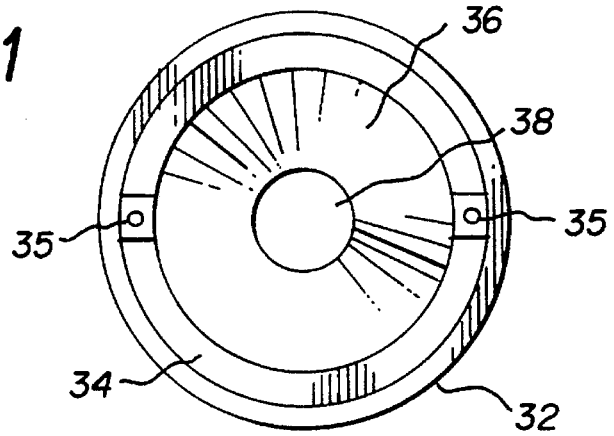
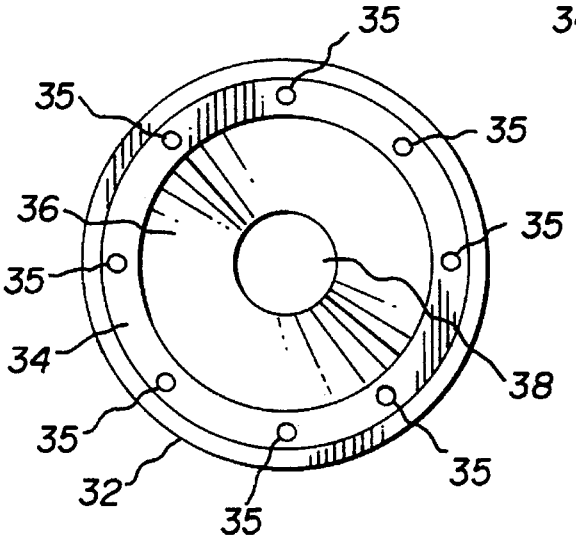
FIG. 12
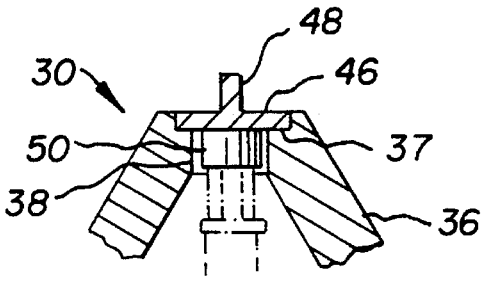
FIG. 13

FIG. 18
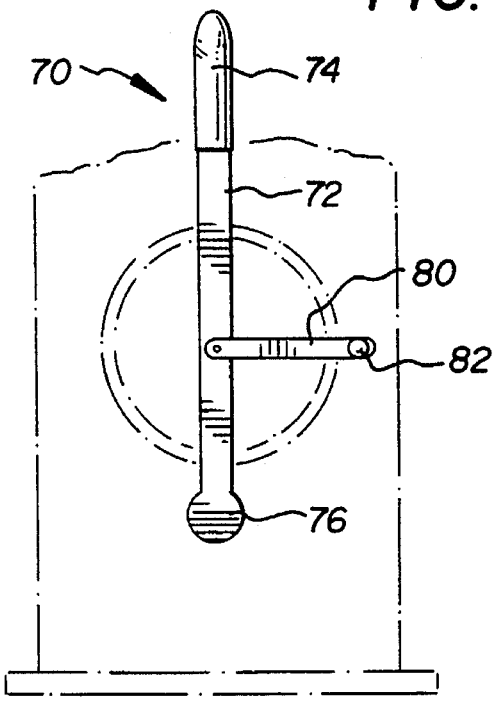
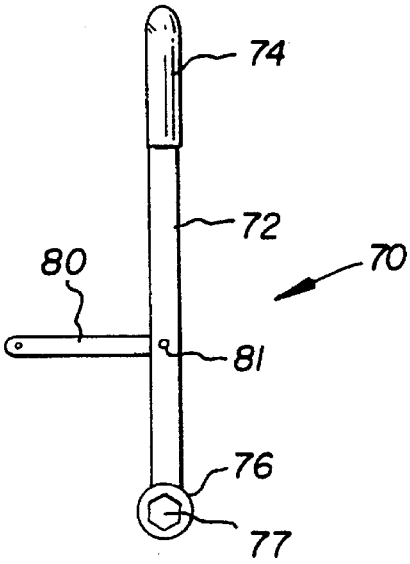
FIG. 19
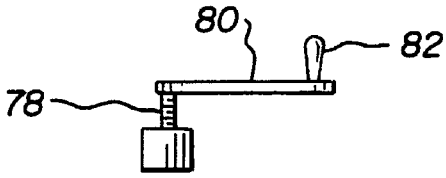
FIG. 20
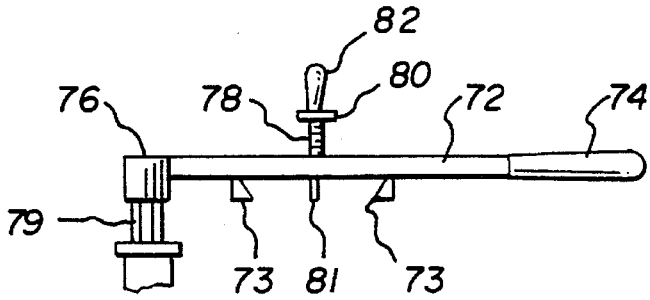
FIG. 21
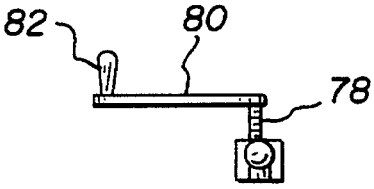
FIG. 22

SECURITY DEVICE AND SYSTEM FOR PREVENTING UNAUTHORIZED ACCESS TO AND OPERATION OF FIRE HYDRANTS

FIELD OF THE INVENTION

The present invention relates to security devices and, more particularly, to security devices for fire hydrants and a system for preventing unauthorized access to and operation of fire hydrants.

BACKGROUND OF THE INVENTION

Fire fighters need quick and reliable access to water to extinguish fires. Conventional fire hydrants suffer from the disadvantage that the caps covering the outlet ports of the hydrant often are difficult to remove due to, for example, corrosion or damaged threads. If a cap cannot be removed quickly, i.e., in less than about one minute, then fire fighters at the nozzle end of the hose can be trapped near the fire without water. In addition, if fire fighters must struggle to remove a cap from a hydrant, then they are subject to injuries such as strained backs and broken fingers.

Conventional fire hydrants also suffer from the disadvantage that they are prone to vandalism and unauthorized operation. Particularly in urban areas, vandals have been known to open hydrants by unscrewing one of the caps and to place objects such as bottles and rags in the hydrant. If the object is not removed from the hydrant when a hose is connected thereto, then it can pass out of the hydrant through the hose and jam the pumps of a fire engine. When the pumps jam, the flow of water to the fire fighters is interrupted, which places the fire fighters in a dangerous situation.

Vandals and other unauthorized persons also have been known to operate fire hydrants. Unauthorized operation is undesirable because it often reduces water pressure below the pressure required for effectively delivering water to fires. Such reduced water pressure creates a dangerous condition for fire fighters and the surrounding community. Unauthorized operation also can cause water pressure to build up within the hydrant. This creates a dangerous condition because the increased water pressure within the hydrant cannot be detected by examining the outside of the hydrant. When such a hydrant is opened, the unexpected surge of water rushing from the hydrant may injure the person opening the hydrant or other persons near the hydrant.

Despite longstanding efforts to develop a tamperproof fire hydrant, unauthorized access to and operation of fire hydrants remains a significant problem, particularly in urban areas. Accordingly, it is an object of the invention to provide a security device for preventing unauthorized access to and operation of fire hydrants.

Another object of the invention is to provide a system for preventing unauthorized access to and operation of fire hydrants.

Additional objects and advantages of the invention will be set forth in part in the description which follows, and in part will be obvious from the description, or may be learned by practice of the invention. The objects and advantages of the invention will be realized and attained by means of the instrumentalities and combinations particularly pointed out in the appended claims.

SUMMARY OF THE INVENTION

To achieve the objects and in accordance with the purpose of the invention, as embodied and broadly described herein, the security device for a fire hydrant of the invention includes a first end portion for coupling the device to a portion of the hydrant. The first end portion preferably is coupled to the hydrant by clamping it between an outlet port of the hydrant and a cap for covering the outlet port. A second end portion covers a valve control device of the hydrant to control access to the valve control device and thereby prevent unauthorized persons from activating it. An intermediate portion integral with the first and second end portions extends vertically from the first end portion to the second end portion.

The system for preventing unauthorized operation of a fire hydrant of the invention includes the security device described above, a bonnet for protecting a valve control device of the hydrant, and a locking cap for closing an outlet port of the hydrant. The bonnet preferably includes an upper portion having a generally frustoconical configuration that serves to surround and protect the valve control device. The bonnet is provided with an opening at the top thereof for accessing the valve control device. The system also may include a tool for removing the locking cap from the outlet port and for opening the valve control device.

In a first alternative embodiment of the security device, the first end portion is provided with a tubular member for protecting the outlet port and the locking cap of the hydrant. In a second alternative embodiment of the security device, the locking cap for covering the outlet port is built-in or integral with the first end portion of the security device.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

FIG. 10 is an elevational view of the bonnet of the system of the present invention.

FIG. 11 is a bottom view of the bonnet.

FIG. 12 is a bottom view of another embodiment of the bonnet.

FIG. 13 is a sectional view of the bonnet showing the second end or cap portion of the security device of the present invention situated therein.

FIG. 18 is a top view showing the tool of the system of the present invention in use to open a locking cap.

FIG. 19 is a bottom view of the tool.

FIG. 20 is a rear view of the tool.

FIG. 21 is a side view showing the tool in use to open a valve control device of a fire hydrant.

FIG. 22 is a front view of the tool.

DETAILED DESCRIPTION OF THE PREFERRED EMBODIMENTS

Reference will now be made to the present preferred embodiments of the invention, examples of which are illustrated in the accompanying drawings.

Figure 3:
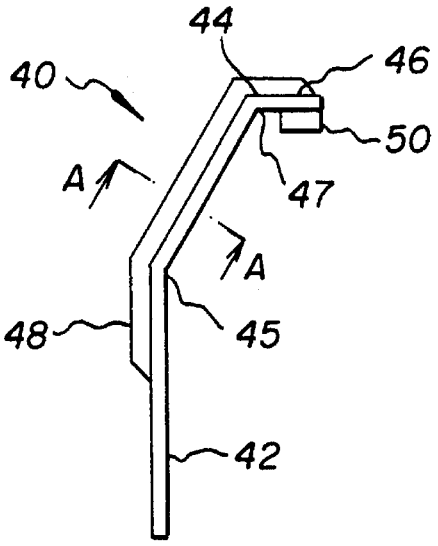
FIG. 3 is a side view of one embodiment of the security device of the present invention.

The security device of the present invention is shown in detail in FIGS. 3–9. As shown in FIG. 3, security device 40 includes first end portion 42, intermediate or neck portion 44, and second end or cap portion 46. Security device 40 may be made of steel or any other suitable material.

Figure 1:
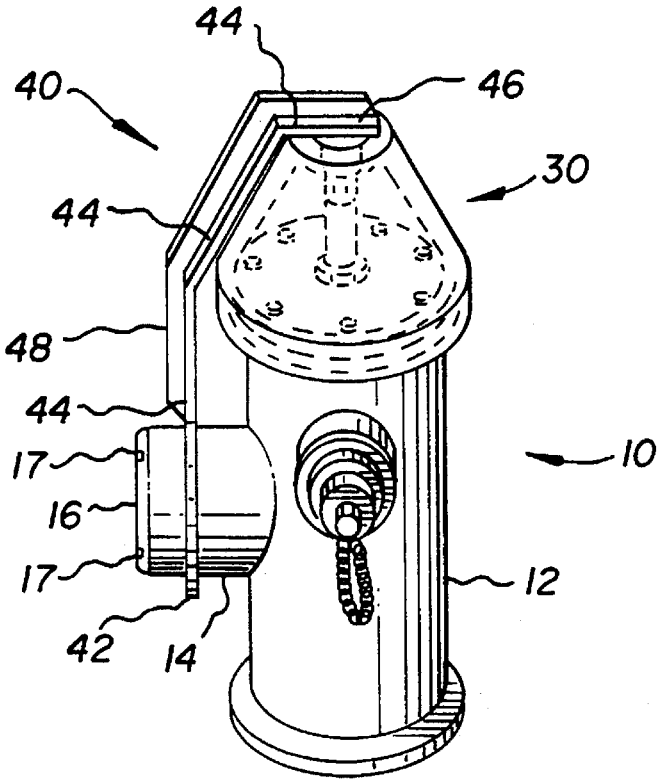
FIG. 1 is a perspective view of one embodiment of the security device of the present invention mounted on a fire hydrant.
Figure 4:
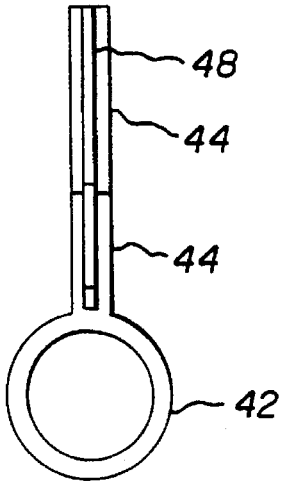
FIG. 4 is a rear view of one embodiment of the security device of the present invention.
Figure 5:
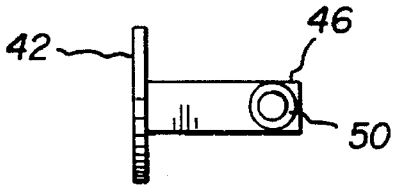
FIG. 5 is a bottom view of one embodiment of the security device of the present invention.

First end portion 42 is for coupling the security device to a portion of a fire hydrant. As shown in FIG. 4, first end portion 42 is shaped in the form of a ring having opening 43. The diameter of opening 43 is selected to be just greater than an outer diameter of an outlet port of the fire hydrant to which the security device is to be coupled. This configuration allows first end portion 42 to be coupled to a fire hydrant by clamping it between an outlet port and the cap for covering the outlet port. As shown in FIG. 1, which will be discussed in detail later, first end portion 42 is clamped between outlet port 14 and cap 16 of hydrant 10.

Figure 6:
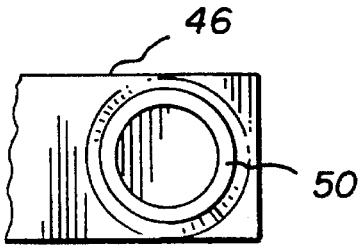
FIG. 6 is an enlarged view of one embodiment of the second end or cap portion of the security device of the present invention.
Figure 7:
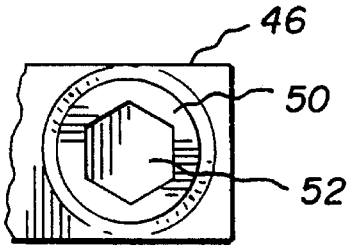
FIG. 7 is an enlarged view of another embodiment of the second end or cap portion of the security device of the present invention.

Second end or cap portion 46 is for covering a valve control device of a fire hydrant to control access to the valve control device and thereby prevent unauthorized persons from activating the valve control device. As can be seen in FIG. 3, second end portion 46 is laterally displaced with respect to first end portion 42. The distance by which second end portion 46 is laterally displaced with respect to first end portion 42 is selected to position second end portion 46 over the valve control device of the fire hydrant and, consequently, is a function of the size of the fire hydrant to which the security device is to be mounted. As shown in FIG. 3, second end portion 46 includes protrusion 50 for covering the valve control device of the fire hydrant. In one embodiment of the present invention, protrusion 50 has a hollow cylindrical configuration as shown in FIG. 6. In another embodiment of the invention, protrusion 50 has a solid cylindrical configuration in which recess 52 is provided as shown in FIG. 7. The recess may be shaped to accommodate the valve control device. Recess 52 shown in FIG. 7 is hexagonally shaped because the valve control device in fire hydrants usually is hexagonally shaped.

Intermediate or neck portion 44 is integral with first end portion 42 and second end portion 46. As shown in FIG. 3, intermediate portion 44 extends vertically from first end portion 42 to second end portion 46. Intermediate portion 44 may be bent in one or more places so that second end portion 46 is approximately perpendicular to first end portion 42. As shown in FIG. 3, intermediate portion 44 includes two approximately 45° bends 45 and 47. Those skilled in the art will recognize that intermediate portion 44 may be bent in other ways or curved to obtain an equivalent structure which will achieve the same result.

Figure 8:
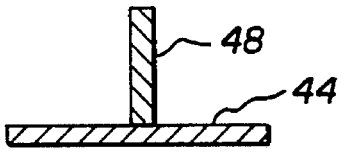
FIG. 8 is a sectional view of one embodiment of the security device of the present invention taken along line A—A in FIG. 3.
Figure 9:
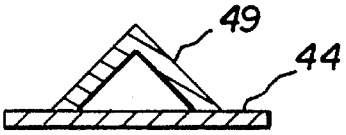
FIG. 9 is a sectional view of another embodiment of the security device of the present invention taken along line A—A in FIG. 3.
Figure 17:
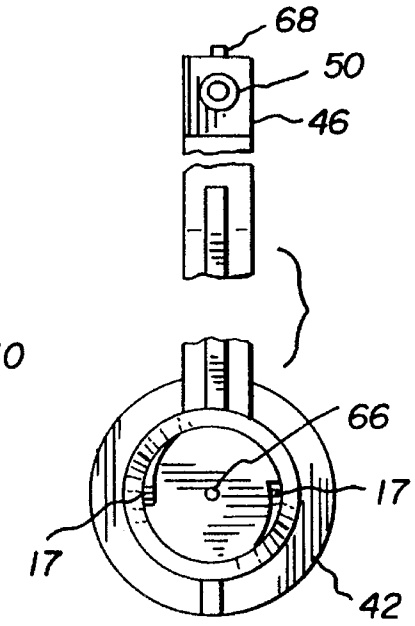
FIG. 17 is a fragmented view of the second alternative embodiment of the security device shown in FIG. 16 including a front view of the first end portion and a bottom view of the second portion.

If desired, security device 40 may be provided with a longitudinally extending rib for reinforcing the device. As shown in FIG. 3, intermediate portion 44 and second end portion 46 have longitudinally extending rib 48 thereon for reinforcing those portions of the device. Rib 48 may be a flat strip of steel or other suitable material affixed approximately perpendicular to the outer surface of intermediate portion 44 as shown in FIG. 8. Alternatively, as shown in FIG. 9, the reinforcing rib may be comprised of V-shaped arrangement 49. Those skilled in the art will recognize that reinforcing ribs having other configurations also may be used. Those skilled in the art will further recognize that the added strength provided by the reinforcing rib also may be obtained by fabricating the security device from high strength material or by increasing the thickness of the device.

The security device of the present invention is suitable for use with conventional fire hydrants. Those skilled in the art will recognize that the degree of security afforded by the security device of the present invention is limited when the security device is coupled to a fire hydrant by clamping it between an outlet port and a cap threaded onto the outlet port. Thus, it is preferred that the security device be used as a component in the system for preventing unauthorized operation of a fire hydrant of the present invention. The system of the present invention includes the security device described above, a bonnet for protecting a valve control device of a fire hydrant, and a locking cap for closing an outlet port of a fire hydrant. The system also may include a tool for opening the locking cap and for operating the valve control device of the fire hydrant.

The bonnet of the system of the present invention is shown in detail in FIGS. 10–13. As shown in FIG. 10, bonnet 30 includes lower portion 32, shoulder 33, upper portion 36, and opening 38. Bonnet 30 may be made of steel or any other suitable material. Lower portion 32 has the configuration of a hollow cylinder and serves to restrict access to the bolts used to secure bonnet 30 to the standpipe. Upper portion 36 has a generally frustoconical configuration and serves to surround and protect the valve control device of a fire hydrant. The transition from lower portion 32 to upper portion 36 occurs at shoulder 33. The diameter of upper portion 36 tapers gradually from a maximum near shoulder 33 to a minimum at opening 38 for accessing a valve control device of a fire hydrant. As shown in FIGS. 11 and 12, ledge 34 is provided in the interior of bonnet 30 at shoulder 33. Ledge 34 acts as a seat for resting bonnet 30 on the standpipe of a fire hydrant. As shown in FIG. 11, two holes 35 are provided in ledge 34 for securing bonnet 30 to the standpipe. If necessary, additional holes 35 or recesses may be provided in ledge 34 as shown in FIG. 12 to accommodate the bolts used to affix a top plate to the standpipe so that the bonnet flatly rests on the top plate.

If desired, bonnet 30 may be provided with recess 37 as shown in FIG. 13. Recess 37 is configured to receive second end portion 46 of security device 50 and serves to anchor second end portion 46 in the top portion of bonnet 30. The depth of recess 37 shown in FIG. 13 is such that the top surface of second end portion 46 is flush with the top surface of bonnet 30. Alternatively, the depth of recess 37 may be increased so that the top surface of second end portion 46 is disposed below the top surface of bonnet 30.

Figure 2:
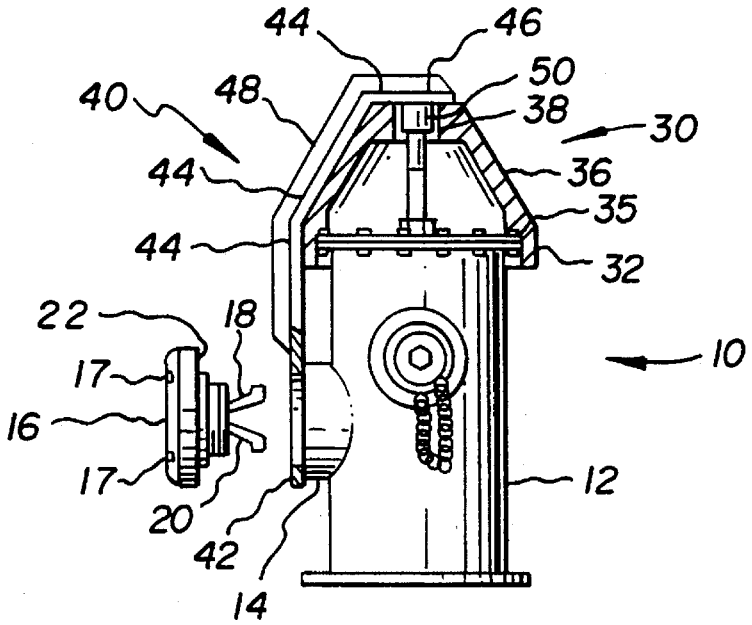
FIG. 2 is an elevational view of one embodiment of the security device of the present invention mounted on a fire hydrant.
Figure 14:
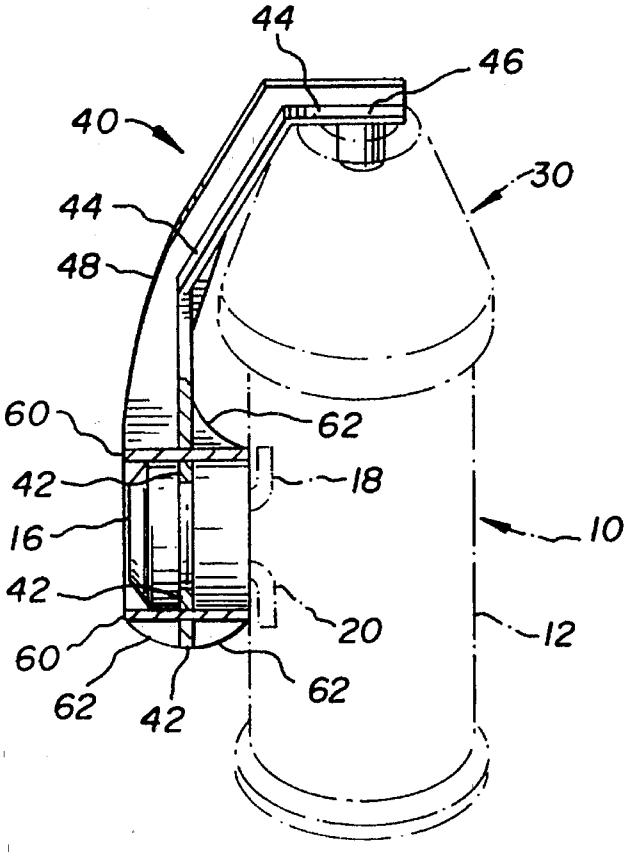
FIG. 14 is a perspective view of a first alternative embodiment of the security device of the present invention mounted on a fire hydrant.

The locking cap of the system of the present invention is shown as a separate component in FIGS. 1, 2, and 14. The locking cap is shown as an integral component of the security device of the present invention in FIG. 16. As can be seen in FIG. 2, locking cap 16 includes a pair of retractable tongs 18 and 20. When in the retracted position, the distance between tongs 18 and 20 is such that they can be inserted into outlet port 14. When in the extended position, the distance between tongs 18 and 20 is such that the end portions or toes of tongs 18 and 20 engage against the interior wall of the standpipe and thereby prevent locking cap 16 from being removed from outlet port 14. A suitable clamping unit for moving tongs 18 and 20 between the retracted and extended positions is disclosed in U.S. Pat. No. 3,914,966 to Bello, the disclosure of which is hereby incorporated by reference. In general, the clamping unit disclosed in the patent to Bello operates through the use of a rod which displaces a spring-loaded bridge. Movement of the spring-loaded bridge moves the tongs either into the extended position or into the retracted position.

The system of the present invention is shown in combination with a fire hydrant in FIGS. 1 and 2. Bonnet 30 is disposed on a top plate connected to standpipe 12 so that the top portion of bonnet 30 surrounds and protects the valve control device of hydrant 10. Security device 40 is mounted on hydrant 10 so that second end portion 46 covers the valve control device of hydrant 10. In particular, protrusion 50 extends from second end portion 46 into opening 38 of bonnet 30 to cover the valve control device of hydrant 10 thereby restricting access to the valve control device. Security device 40 is coupled to hydrant 10 by clamping first end portion 42 between outlet port 14 and locking cap 16 as shown in FIG. 1. As can be appreciated from FIG. 2, security device 40 is coupled to hydrant 10 by first aligning device 40 on hydrant 10 so that protrusion 50 covers the valve control device and opening 43 in first end portion 42 receives outlet port 14. Locking cap 16 is then secured to hydrant 10 both to close outlet port 14 and also to secure first end portion 42 to outlet port 14 by clamping first end portion 42 between ledge 22 around the circumference of the back side of cap 16 and outlet port 14. If desired, the front face of cap 16 may be provided with rounded corners as shown in FIG. 2. Such rounded corners make it more difficult for vandals attempting to break into the hydrant to strike cap 16 with a direct downward blow with, for example, a sledgehammer.

FIGS. 18–22 show a preferred tool for use with the system of the present invention. As shown in FIG. 18, tool 70 includes handle 72 having grip portion 74 at one end, a threaded bore (not shown) in the central portion thereof, and wrench portion 76 at the opposite end. As can be seen in FIGS. 20–22, threaded member 78 extends through the threaded bore in the central portion of handle 72. Crank arm 80 having handle 82 thereon is provided on threaded member 78. As shown in FIG. 21, pin 81 is provided at the end of threaded member 78 opposite crank arm 80. Also as shown in FIG. 21, protrusions 73 are provided on the bottom surface of handle 72.

Tool 70 is designed to perform two functions in the system of the present invention. The first function is to facilitate removal of the locking cap from the outlet port of a fire hydrant. As shown in FIG. 18, this is accomplished by mounting tool 70 on the front face of the locking cap and rotating crank arm 80 so that pin 81 on threaded member 78 causes a rod in the clamping unit of the locking cap to displace the spring-loaded bridge. Tool 70 is mounted on the front face of the locking cap by placing protrusions 73 on handle 72 in suitably shaped recesses 17, which are shown, for example, in FIGS. 1 and 2. As described above, displacement of the spring-loaded bridge moves the tongs into the retracted position and allows the locking cap to be removed from the outlet port of the hydrant.

The second function of tool 70 is to open the valve control device of the fire hydrant. As shown in FIG. 21, this is accomplished using wrench portion 76 of tool 70 to rotate and thereby open the valve control device of the fire hydrant. Wrench portion 76 is adapted for use with the bonnet of the system of the present invention. In particular, wrench portion 76 includes extended portion 79 having a length sufficient to pass through the opening in the bonnet of the system of the present invention and reach the valve control device of the fire hydrant. The configuration of extension portion 79 is selected to mate with the valve control device of the fire hydrant which, as discussed above, usually is hexagonally shaped. As shown in FIG. 21, extension portion 79 is a solid hexagonally shaped member in which, as can be seen in FIG. 19, hexagonally shaped recess 77 is provided. Those skilled in the art will recognize that the configuration of the extension portion 79 may be varied by changing the exterior shape to, for example, a cylindrical configuration or by changing the shape of the recess to accommodate valve control devices that are not hexagonally shaped.

Figure 15:
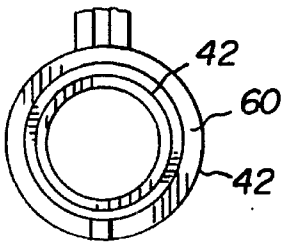
FIG. 15 is a partial front view of the first alternative embodiment of the security device shown in FIG. 14.

FIGS. 14–17 show alternative embodiments of the security device of the present invention. In the first alternative embodiment shown in FIG. 14, first end portion 42 of security device 40 is provided with tubular member 60 for protecting outlet port 14 and locking cap 16 of hydrant 10. Tubular member 60 extends from first end portion 42 so that a portion of first end portion 42 is within tubular member 60 as can be seen in FIGS. 14 and 15. Security device 40 is coupled to hydrant 10 by clamping the portion of first end portion 42 within tubular member 60 between outlet port 14 and locking cap 16. The inner diameter of tubular member 60 is selected so that tubular member 60 fits over and encases outlet port 14 and locking cap 16. The length of tubular member 60 preferably is selected so that tubular member 60 covers the entire outlet port 14 and the entire locking cap 16. If desired, the length of tubular member 60 may be varied so that a relatively small portion of outlet port 14 adjacent to standpipe 12 is not covered. The length of tubular member 60 also may be varied so that tubular member 60 slightly overlaps the front face of locking cap 16. In this case, however, the degree of overlap must not be so large as to prevent the tool for removing locking cap 16 from being mounted on the front face thereof as described above. As shown in FIG. 14, longitudinal rib 48 extends away from the outer surface of intermediate portion 44 at an angle so that the top surface of longitudinal rib 48 is approximately flush with the outer face of tubular member 60. If desired, circumferential reinforcement portions 62 may be provided on the outer surface of the tubular member 60.

Figure 16:
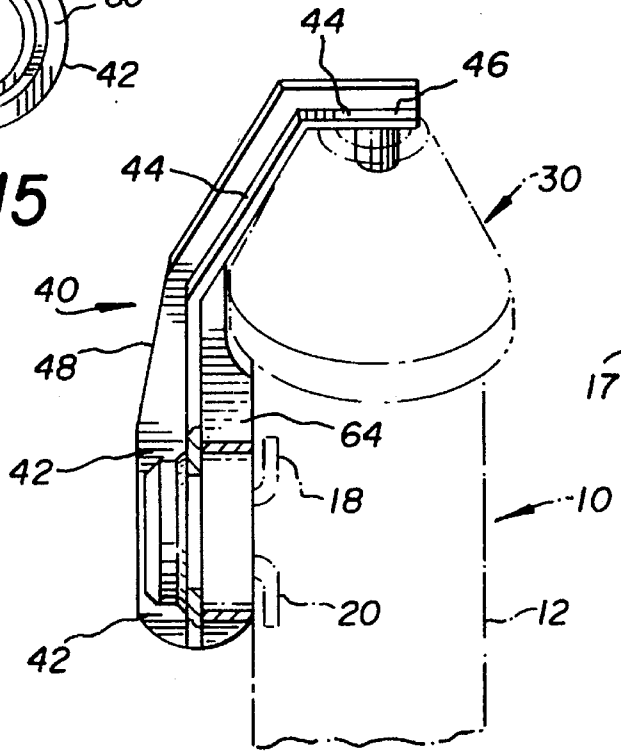
FIG. 16 is a perspective view of a second alternative embodiment of the security device of the present invention mounted on a fire hydrant.

In the second alternative embodiment shown in FIG. 16, the locking cap for covering the outlet port is built-in or integral with first end portion 42 of security device 40. As can be appreciated from FIG. 17, the front face of the locking cap is flush with the outer surface of the security device. This allows the tool for removing the locking cap to be mounted in recesses 17. When the crank arm of the tool is rotated, the pin on the threaded member causes rod 66 in the clamping unit of the locking cap to displace the spring-loaded bridge and move the tongs into the retracted position, which allows the locking cap to be removed from the outlet port of the hydrant. Tab 68 on second end portion 46 shown in FIG. 17 fits in a suitably shaped recess in bonnet 30. In the event a vandal attempts to pry second end portion 46 away from bonnet 30 with, for example, a crowbar, tab 68 engages with the recess and prevents second end portion 46 from moving. The device shown in FIG. 16 also is provided with longitudinal rib 64 on the inner surface of intermediate portion 44. In addition to strengthening security device 40, longitudinal rib 64 closes off or blocks the space between the inner surface of intermediate portion 44 and hydrant 10. This prevents vandals from running a pipe or other object through that space to gain leverage in an effort to remove or damage security device 40. As can be seen in FIG. 16, the shape of longitudinal rib 64 is such that the top surface of longitudinal rib 64 generally conforms to the profile of the fire hydrant in the region of intermediate portion 44 in which longitudinal rib 64 is provided.

It will be apparent to those skilled in the art that various modifications and variations can be made in the security device and system of the invention without departing from the scope of the invention as defined in the following claims.

I claim:

1. A security device for preventing unauthorized use of a fire hydrant, comprising:

a first end portion for coupling to a portion of a fire hydrant, said first end portion being in the shape of a ring having an opening having a diameter just greater than an outer diameter of an outlet port of said fire hydrant for receiving said outlet port;

a second end portion having a protrusion for covering an actuating end of a valve stem of a valve control device of said fire hydrant; and an intermediate portion integral with said first end portion and said second end portion, said intermediate portion extending from said first end portion to said second end portion.

2. The security device of claim 1, wherein said protrusion is a hollow cylinder.

3. The security device of claim 1, wherein said protrusion is a solid cylinder provided with a recess.

4. The security device of claim 3, wherein said recess is shaped to receive said valve control device of said fire hydrant.

5. The security device of claim 4, wherein said recess is hexagonally shaped.

6. The security device of claim 1, wherein said second end portion is laterally displaced with respect to said first end portion.

7. The security device of claim 1, wherein said intermediate portion and said second end portion have a longitudinally extending rib thereon for reinforcing said intermediate portion and said second end portion.

8. The security device of claim 1, wherein said first end portion is provided with a tubular member.

9. The security device of claim 8, wherein said tubular member extends from said ring so that an inner portion of said ring is disposed within said tubular member.

10. A system for preventing unauthorized operation of a fire hydrant, said system comprising:

a bonnet having an upper portion and a lower portion, said upper portion having a generally frustoconical configuration and having an opening therein for accessing an actuating end of a valve stem of a valve control device of a fire hydrant, said lower portion having a hollow, cylindrical configuration;

a security device for controlling access to said actuating end of said valve stem of said valve control device of said fire hydrant, said security device comprising:

a first end portion for securing said security device to said fire hydrant, said first end portion having an opening for receiving an outlet port of said fire hydrant;

a second end portion for covering said opening in said bonnet to prevent access to said actuating end to thereby prevent operation of said valve control device; and an intermediate portion integral with said first end portion and said second end portion, said intermediate portion extending from said first end portion to said second end portion; and a locking cap for closing said outlet port of said fire hydrant, said locking cap securing said first end portion of said security device to said outlet port of said fire hydrant.

11. The system of claim 10, further comprising:

a tool for removing said locking cap from said outlet port and for opening said valve control device, said tool comprising a handle having a grip portion at one end, a threaded bore in a central portion thereof, and a wrench portion at an opposite end, and a threaded member extending through said threaded bore in said handle, said threaded member having a crank arm thereon.

12. The system of claim 10, wherein said second end portion has a protrusion for covering said valve control device of said fire hydrant.

13. The system of claim 12, wherein said protrusion is a hollow cylinder.

14. The system of claim 12, wherein said protrusion is a solid cylinder provided with a recess.

15. The system of claim 14, wherein said recess is hexagonally shaped.

16. The system of claim 10, wherein said upper portion of said bonnet is provided with a recess for receiving said second end portion of said security device.

17. A security device for preventing unauthorized use of a fire hydrant, comprising:

a first end portion for receiving an outlet port of a fire hydrant, said first end portion including a locking cap for securing said first end portion to said outlet port;

a second portion having a protrusion for covering an actuating end of a valve stem of a valve control device of said fire hydrant; and an intermediate portion integral with said first end portion and said second end portion, said intermediate portion extending from said first end portion to said second end portion.

18. The security device of claim 17, wherein said protrusion is a hollow cylinder.

19. The security device of claim 18, wherein said protrusion is a solid cylinder provided with a recess.

20. The security device of claim 19, wherein said recess is hexagonally shaped.

21. A security device for preventing unauthorized use of a fire hydrant, comprising:

a unitary element, said element having a first end, a second end, and an intermediate portion extending between said first and second ends;

said first end including means for receiving an outlet port of a fire hydrant and coupling said first end to said outlet port; and said second end including means for covering an actuating end of a valve stem of a valve control device of said fire hydrant to prevent access thereto.

22. A security device for preventing unauthorized use of a fire hydrant, comprising:

a unitary element, said element having a first end, a second end, and an intermediate portion extending between said first and second ends;

said first end including cap means for covering an outlet port of a fire hydrant, said cap means including means for locking said cap means to said outlet port; and said second end including means for covering an actuating end of a valve stem of a valve control device of said fire hydrant to prevent access thereto.

* * * * *